United States Patent [19]

Jackson

[11] 4,384,431

[45] May 24, 1983

[54] METHODS OF AND APPARATUS FOR PREPARING AN END PORTION OF A LIGHTGUIDE FIBER

[75] Inventor: Kenneth W. Jackson, Lawrenceville, Ga.

[73] Assignee: Western Electric Company, Inc., New York, N.Y.

[21] Appl. No.: 135,807

[22] Filed: Mar. 31, 1980

[51] Int. Cl.[3] ..... B24B 7/02

[52] U.S. Cl. ..... 51/34 E; 51/35; 51/56 R; 51/216 R; 51/283 R; 409/191

[58] Field of Search ..... 51/5 C, 31, 32, 33 R, 51/34 R, 34 E, 35, 37, 55, 56 R, 98 R, 98 BS, 125, 181, 216 R, 217 R, 227 R, 227 H, 283 R, 281 R, 289 R, 165.78; 409/190, 191; 125/13 R

[56] References Cited

U.S. PATENT DOCUMENTS

| | | | |
|---|---|---|---|
| 876,428 | 1/1908 | Blessing | 51/122 X |
| 1,269,653 | 6/1918 | Smith | 51/181 X |
| 2,815,619 | 12/1957 | Brownley | 51/56 X |
| 2,821,815 | 2/1958 | Banko | 51/34 R |
| 2,855,733 | 10/1958 | Allison | 51/33 R X |
| 3,156,035 | 11/1964 | Diehl et al. . | |
| 3,158,968 | 12/1964 | Ness | 51/216 R X |
| 3,828,758 | 8/1974 | Cary | 125/13 R |
| 3,868,794 | 3/1975 | Zitkas | 51/327 X |
| 4,272,926 | 6/1981 | Tamulevich | 51/216 R |

FOREIGN PATENT DOCUMENTS

| | | | |
|---|---|---|---|
| 838573 | 5/1952 | Fed. Rep. of Germany | 51/165.78 |
| 52-14995 | 2/1977 | Japan | 51/125 |

*Primary Examiner*—Stephen G. Kunin
*Assistant Examiner*—Robert P. Olszewski
*Attorney, Agent, or Firm*—E. W. Somers

[57] ABSTRACT

A conical end portion of a connector plug and an end portion of a lightguide fiber which is encapsulated by the plug are prepared to form a conical end portion which is suitable for interconnection with a conical end portion of another plug within a sleeve with precise end separation of opposing end portions of the fibers. The conical portion of the plug is seated in engagement with a surface which is mateable with the outwardly facing surface of a conical end portion of the plug with an end portion of the fiber extending beyond the plug. In order to prepare the lightguide fiber, a disc which is mounted for rotation about an axis that is parallel to the longitudinal axis of the end portion of the lightguide fiber is moved along a path of travel obliquely transverse of the lightguide fiber. This disc is rotated to cause its peripheral edge surface to sever the portion of the lightguide fiber that extends from the plug to form an end surface. Then the radial surface of the disc is caused to abrade the newly formed end surface of the lightguide fiber as well as an end of the conical end portion of the plug. The movement of the disc along its path of travel is discontinued when the disc is spaced a predetermined distance from a peripheral boundary of the mating surface which engages the outwardly facing conical surface of the plug. As a result, the end surface of the fiber is spaced a predetermined distance from a reference dimension of a corresponding peripheral boundary of the plug. Since the configuration of the mating surface is equivalent to at least portions of the sleeve which engage the conical portions of the plugs, the controlled abrading causes the ends of the fibers of the plugs which are assembled to the sleeve to have a controlled end separation.

15 Claims, 12 Drawing Figures

METHODS OF AND APPARATUS FOR PREPARING AN END PORTION OF A LIGHTGUIDE FIBER

TECHNICAL FIELD

This invention relates to methods of and apparatus for preparing an end portion of lightguide fiber, and more particularly, to the preparation of an end portion of a lightguide fiber and connector element to facilitate connectorization.

BACKGROUND OF THE INVENTION

Over the past several years, there has been a growing interest in optical communications. Experimental systems have been installed and evaluated and commercial installations have been planned in several areas of the country.

Two types of cables are used in optical communications, one including a plurality of fiber lightguides which are generally arranged in ribbons and in arrays, and another which is a single lightguide fiber. The single lightguide fibers have been used to interface electrical and optical apparatus such as, for example, regenerators and signal coders and to provide optical patch cords and jumper cables for a main distributing frame.

Each of the above-described cables has its own distinct connection technology. In making a single, fiber-to-fiber connection, end portions of the two lightguide fibers to be spliced together must be aligned coaxially such that end faces of the opposing fibers are in a predetermined relationship to each other. This is important, particularly since signal losses which are introduced by axial misalignment and end separation are synergistically cumulative.

A single fiber lightguide connector may be one such as that shown on pages 89–90 of an article by T. L. Williford et al entitled "Interconnection for Lightguide Fibers" published in the Winter 1980 issue of the *Western Electric Engineer.* The basic elements of the connector are a single fiber within a cable sheath that provides protection and mechanical strength, a plastic conical plug at the end of the fiber with the fiber centered inside the plug and a biconical sleeve which accepts two plugs and causes the alignment of the axes of the fiber ends. The biconical alignment sleeve is a precisely molded part which includes two truncated conical cavities that control the end separation and axial alignment to the end faces of the fibers which are encapsulated within the plugs that are seated in the conical cavities of the sleeve.

In the fabrication of a jumper cable, a single fiber cable is cut to length, and the jacket of the cable is removed from a short length at the cable's end to expose the protruding glass fiber. The coating on the fiber is removed and a precision metallic sleeve is slid over the fiber and the inner and outer cable jackets and crimped around the inner jacket. Then the conical plug is molded concentric with the fiber axis and the metallic sleeve is crimped about the strength member and outer cable jacket so that any tension applied to the cable is transferred to the strength member. The circular symmetry of the conical design provides precise axial alignment of the fiber lightguide cores. Following molding, the plug must be precisely sized to control plug end separation within the biconical alignment sleeve. This is accomplished by grinding the plug length to a tolerance of about ±0.00075 cm. After grinding to size, the fiber end may be polished to provide an optically smooth surface with the plug length remaining substantially constant.

Interconnection requires that the ends of the lightguide fibers be smooth, flat and perpendicular to the fiber lightguide axis and the lightguide axis to be coincident with those of the plugs and the biconical alignment sleeve. End preparation methods which have been used include polishing, sawing, controlled breaking, and manual lapping. The use of an index matching material between fiber ends in a splice may also be used to reduce the signal loss due to reflections and surface imperfections in the end faces of the fibers. A "bend and score" technique for single fiber end preparation is described by J. F. Palgleish in an article entitled "A Review of Optical Fiber Connection Technology" published in the Jan. 31, 1977 issue of *Telephony* magazine.

There is a need for methods and apparatus for the rapid preparation of lightguide fiber ends that are encapsulated in conical plugs in a repetitively controllable fashion to facilitate the factory and/or field connectorization of single fiber lightguide cables. This need is not met by any known apparatus and while the presently used techniques may be used, the elements of control and speed are lacking.

SUMMARY OF THE INVENTION

The hereinbefore described needs for the end preparation of a lightguide fiber encapsulated in a connector element have been met by the methods and the apparatus of this invention. A method of preparing an end portion of a lightguide fiber includes the steps of supporting a lightguide fiber within a holder having an outwardly facing surface with an end portion of the fiber extending from one end of the holder. The holder is positioned by moving the outwardly facing surface of the holder into seating engagement with a surface which is mateable with said outwardly facing surface in a repeatable manner. A tool having a surface which is capable of preparing an end portion of a lightguide fiber is mounted transversely of the longitudinal axis of the end portion of the lightguide fiber and for movement along a path of travel. The tool is moved along the path of travel to cause the toolsurface to prepare an end surface of the end portion of the fiber which extends from one end of the holder. The movement of the worksurface along its path of travel is controlled so that the movement along the path of travel is discontinued when the toolsurface is spaced a predetermined distance from a peripheral boundary of the mating surface to cause the end surface of the lightguide fiber to be spaced a predetermined distance from a reference dimension of the holder.

More specifically, a connector plug which has been priorly assembled to an end portion of a single fiber lightguide cable and molded concentrically with respect to the fiber axis with a single fiber protruding from a conical end portion of the plug is held in a precision truncated conical opening of an annular member. The ends of the fiber and the plug must be prepared so that when two of the plugs are mounted coaxially in a sleeve, the ends of the fibers which oppose each other are in a predetermined relationship with each other. A disc having both a radial abrading surface and a peripheral cutting edge is mounted rotatably along an axis which is parallel to but offset from the axis of the end portion of the fiber and on a carriage which is moveable along a path of travel that is obliquely transverse of the axis of the fiber. As the carriage is moved along its path of travel, the peripheral edge of the disc severs the fiber lightguide to length to form a new end face after which the radial face of the disc abrades the newly formed cross-sectional surface of the fiber and end portion of the plug until these end surfaces are coplanar. The carriage travel is discontinued by a stop when the abraded, newly formed end face of the fiber and end portion of the plug lie in a plane which is spaced a predetermined distance from a peripheral boundary line of the surface which defines the opening of the annular member. Since that opening is equivalent to the opening in the sleeve in which two of the plugs are mounted with the opposing end surfaces of the lightguide fibers having a predetermined end separation, the abrading causes the end face of each fiber to be a predetermined distance from a reference diameter of a corresponding peripheral line of the conical portion of the plug so that the opposing end faces of the fibers are positioned in the predetermined relationship when the plugs are assembled to the sleeve.

In a preferred embodiment of the invention, a surface of the disc is plated with a diamond abrasive material that is interspersed in a metallic matrix to render the disc substantially wear-resistant so that repeatability may be achieved in successive cycles of severing and abrading of assembled end portions of lightguide fibers and connector elements.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 1:
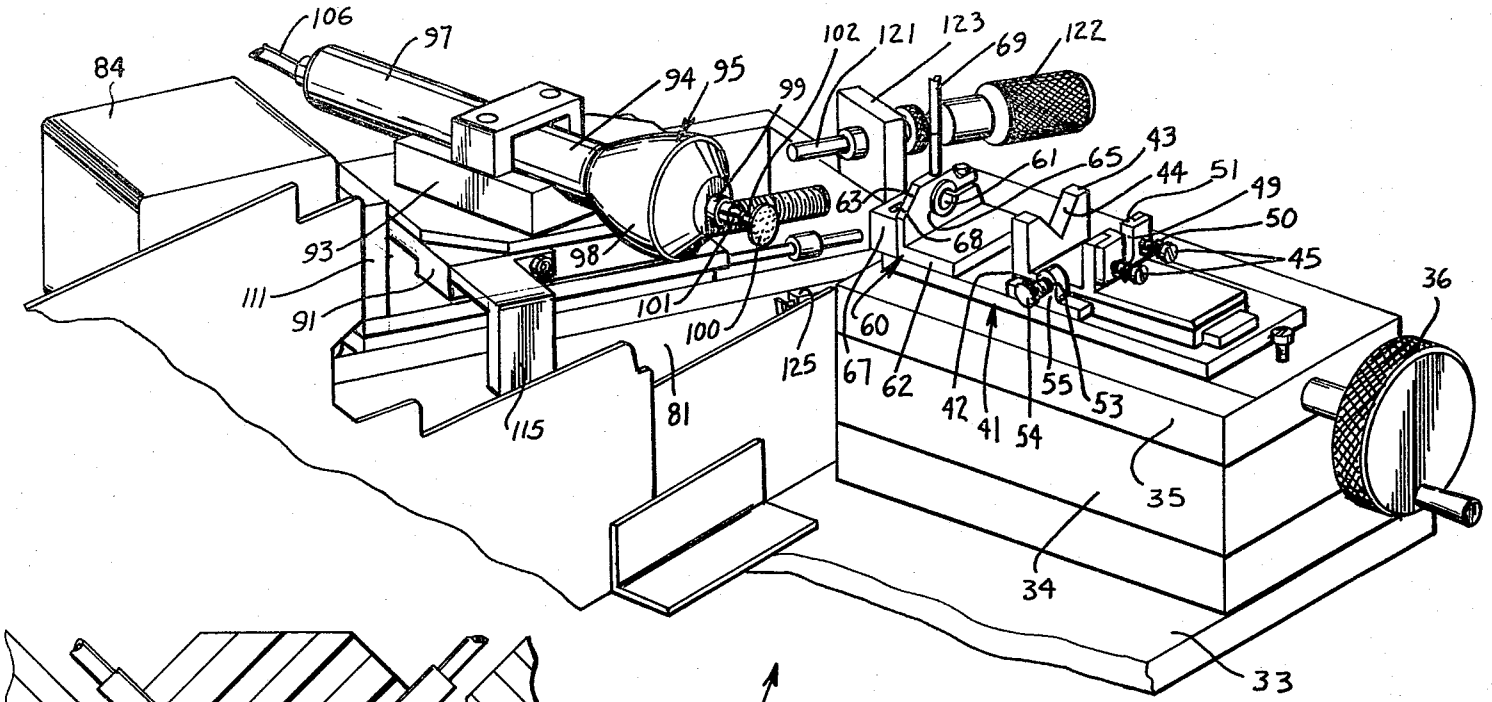
FIG. 1 is a perspective view of an apparatus in accordance with this invention for sizing a plug-terminated end portion of a single lightguide fiber.
Figures 2, 3A:
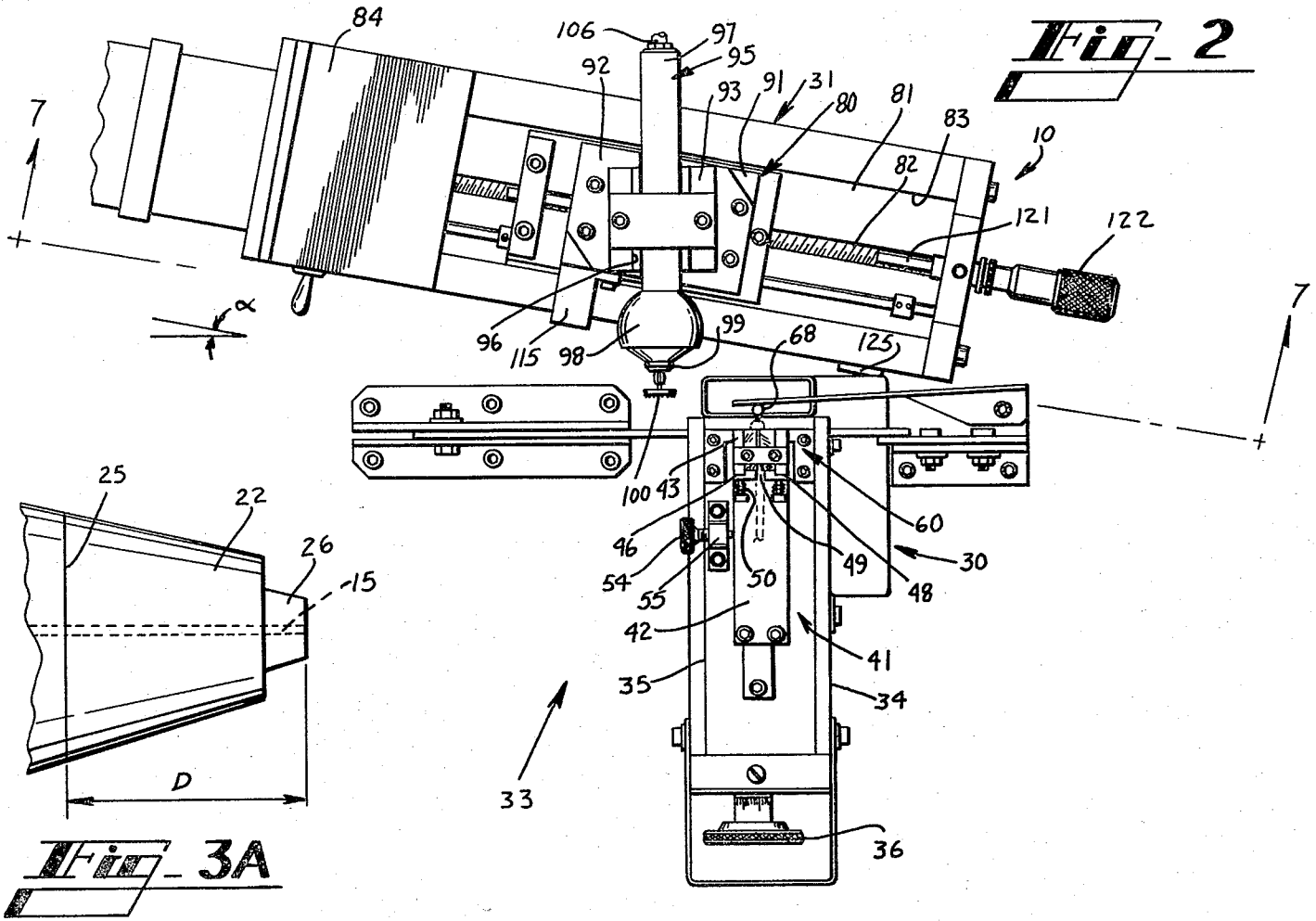
FIG. 2 is a plan view of the apparatus of FIG. 1.
FIG. 3A is an enlarged view of an end portion of a plug-terminated lightguide fiber.
Figure 3:
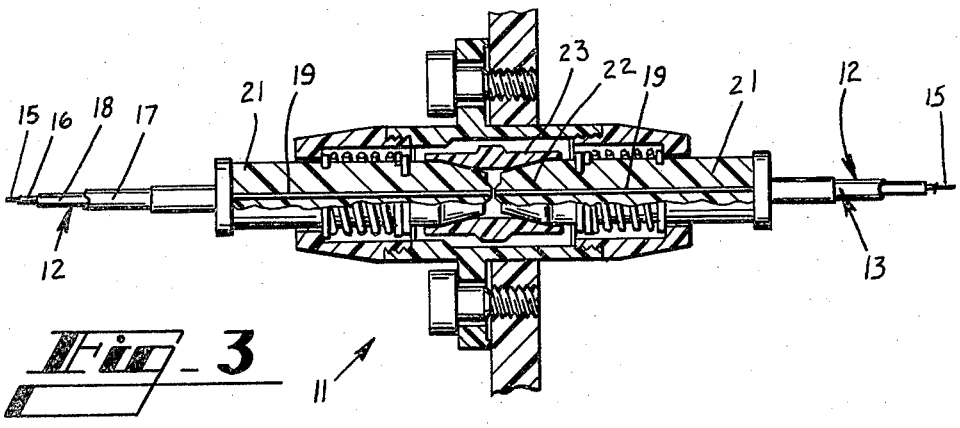
FIG. 3 is an enlarged elevational view partially in section of a single lightguide fiber connector which is formed by assembling two plug-terminated end portions of lightguide fibers which have been prepared in accordance with this invention with a precisely manufactured sleeve.

Referring now to FIGS. 1 and 2, there is shown an apparatus designated generally by the numeral 10 which is a preferred embodiment of this invention and which may be used in the preparation of a single lightguide fiber connector 11 such as that shown in FIG. 3. Single lightguide fiber cables 12—12 which are interconnected with connectors 11—11 are used to interconnect between terminal devices and transmission lines.

As can be seen in FIG. 3, the lightguide fiber cable 12 includes a single lightguide fiber 15 which is enclosed in a sheath 13 that provides mechanical protection and strength. The sheath 13 may include inner and outer plastic jackets 16 and 17 with a strength member 18 which is removed from an end portion 19 of the fiber 15. A cylindrical plastic plug 21 having a conically shaped end portion 22 is molded about the end portion of the fiber 15 with the fiber being centered therein. A biconical sleeve 23 accepts and aligns the conically shaped end portions of the two plugs 21—21. The sleeve 23 is a precisely molded plastic part which controls the alignment and separation of theplugs 21—21 to control the axial alignment and separation of the fibers 15—15. The connector 11 is described in the hereinbefore identified article in the winter 1980 issue of the *Western Electric Engineer.*

Desirably, the seating of the two plugs 21—21 within the sleeve 23 causes the free ends of the plugs to bottom out and to barely engage each other or to be slightly separated. In order to insure that this arrangement will avoid damage to end faces of the lightguide fibers 15—15, the plugs 21—21 must be accurately sized. Although the circular symmetry of the conical design provides precise axial alignment of the fibers 15—15, the arrangement requires precise control of the end separation of the plugs.

Viewing now FIG. 3A, it is seen that the primary conical end portion 22 of plug 21 is formed with a secondary cone 26 which protrudes from its end and which is used in threading the fiber 15 into the molding die (not shown). When the plug 21 is molded about the fiber 15, it is not feasible to cause the end surface of the fiber to be coplanar with the external surface of the secondary cone 26. As a result, the assembly of the plug 21 molded around the end portion 19 of the fiber 15 includes about a 0.6 cm long portion of the fiber protruding from an end portion of the secondary cone 26.

In order to insure the required end separation of the opposing end faces of the fibers 15—15, it becomes necessary to sever the protruding end portion of the fiber 15 and then to abrade it such as by lapping to create a coplanar surface in which are disposed the end surfaces of the fiber 15 and the secondary cone 26. This is accomplished by lapping the end surface which is formed by severing of that surface and that of the secondary cone 26 so that the final plane is a predetermined distance "D", within a tolerance of $+0.00075$ cm, of a reference diameter 25 on the conical surface 22 of the plug 21. In this way, when the conical plugs 21—21 are assembled to the sleeve 23, the opposing end faces of the fibers 15—15 will be separated from each other by a distance which is also within a tolerance of $\pm 0.00075$ cm. Since the plug 21 is not assembled to the sleeve 23 during the lapping, the predetermined distance is measured with respect to a reference diameter of a conical gauge surface which is an image of the surface of the sleeve and which engages and mates with an outwardly facing surface of the conical portion 22 in a repeatable manner.

The apparatus 10 includes holding facilities, designated generally by the numeral 30 which are used to hold the plug 21 with the lightguide fiber 15 extending therefrom, and facilities, designated generally by the numeral 31 which are used to sever and abrade the end of the lightguide fiber to be spaced a predetermined distance from the reference diameter of the plug 21. While in the preferred embodiment, the facilities 31 will be described in terms of severing and lapping the end portion of the fiber 15, it should be understood that they could also be used to sever and to polish, since the difference between lapping and polishing is only a matter of degree.

Going now to the holding fixture 30 for the plug 21 (see FIGS, 1, 2, and 4–5) it is seen that a stand 33 supports a base 34 with a holding fixture 35 being mounted on the base and being adjustable in a direction which is parallel to the axis of the fiber 15 that is encapsulated in the plug 21 by means of a micrometer control 36.

Mounted on the holding fixture 35 is a biconic connector plug support 41 which includes a top portion 42 having a front abutment 43 (see also FIG. 4) extending upwardly therefrom with a V-shaped groove 44 formed in that abutment. Spaced rearwardly from the abutment 43 is a second upstanding portion 46 having a V-shaped groove 47 formed therein with the V-shaped groove 47 being aligned with the groove 44 formed in the abutment 43. Behind the upstanding portion 46 is an end wall 48 having a centrally disposed U-shaped opening 49 formed therein. The wall 48 is mounted in engagement with the upstanding portion 46 by a pair of bolts 45—45 which extend through aligned openings in the end wall and the upstanding portion (see FIG. 5 in particular). Moreover, each of the bolts extending through those openings has a compression spring 50 centrally disposed thereabout between the head of the bolt and the adjacent base of the end wall 43. In this way the end wall 48 is biased into engagement with the upstanding portion 46 but may be moved away therefrom. Further, the end wall 48 has a pair of projecting tabs 51—51 which are used to capture a portion of the biconic plug 21 under the tabs and in engagement with the V-shaped groove 47 in the upstanding portion 46. The support 31 is slidably mounted on the fixture 35 and is maintained in a first unoperated position with a pin 53 having a knob 54 projecting through a bearing 55 and into an opening in a side of the portion 42.

In order to mount a connectorized end portion of a single optical fiber cable 12 in the holding facilities 30 for severing and lapping, the plug 21 is positioned between the two grooves 44 and 47 with a portion opposite from the free end of the lightguide fiber 15 being caught under the tabs 51—51 of the rear wall 48. Moreover, the single fiber lightguide cable 12 with its outer jacket 17 extends through the U-shaped opening 49 of the end wall 48 and out toward an operator. The forward free end portion of the plug 21 with a portion of a lightguide fiber 15 extending therefrom projects from the free end of the abutment 43.

After the plug 21 is positioned, the knob 54 is pulled to withdraw the pin 53 from the opening in the side of the portion 42 and the support 41 with the lightguide fiber extending therefrom is moved slidably toward a second abutment designated generally by the numeral 60. When the pin 54 is withdrawn from the opening in the side of the support 41, the support is moved forwardly to position a leading end of the plug 21 within an annular member 61 (see FIG. 1). Then the operator releases the pin 53 to permit it to be received within another opening in the side of the portion 42 of the support block 41. This positively positions the support and hence the plug 21 and lightguide fiber 15 with respect to the annular member 61 in the holding facilities 30.

Figure 4:
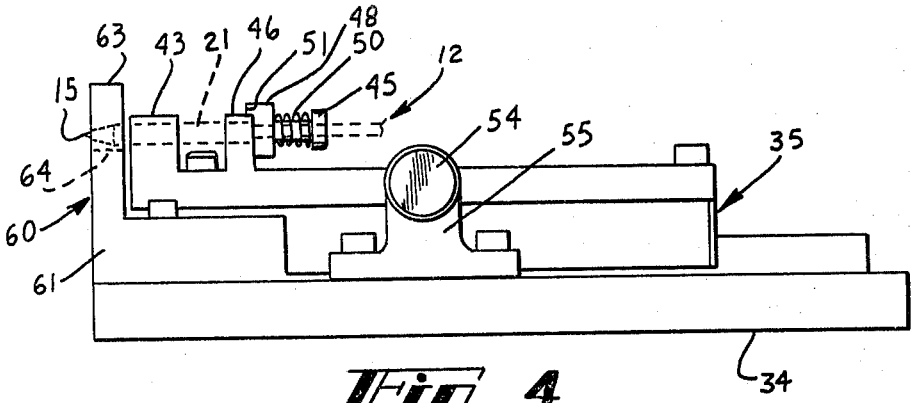
FIG. 4 is an elevational view of facilities for holding an end portion of the plug-terminated lightguide fiber so that it can be prepared in accordance with the methods of this invention.
Figure 5:
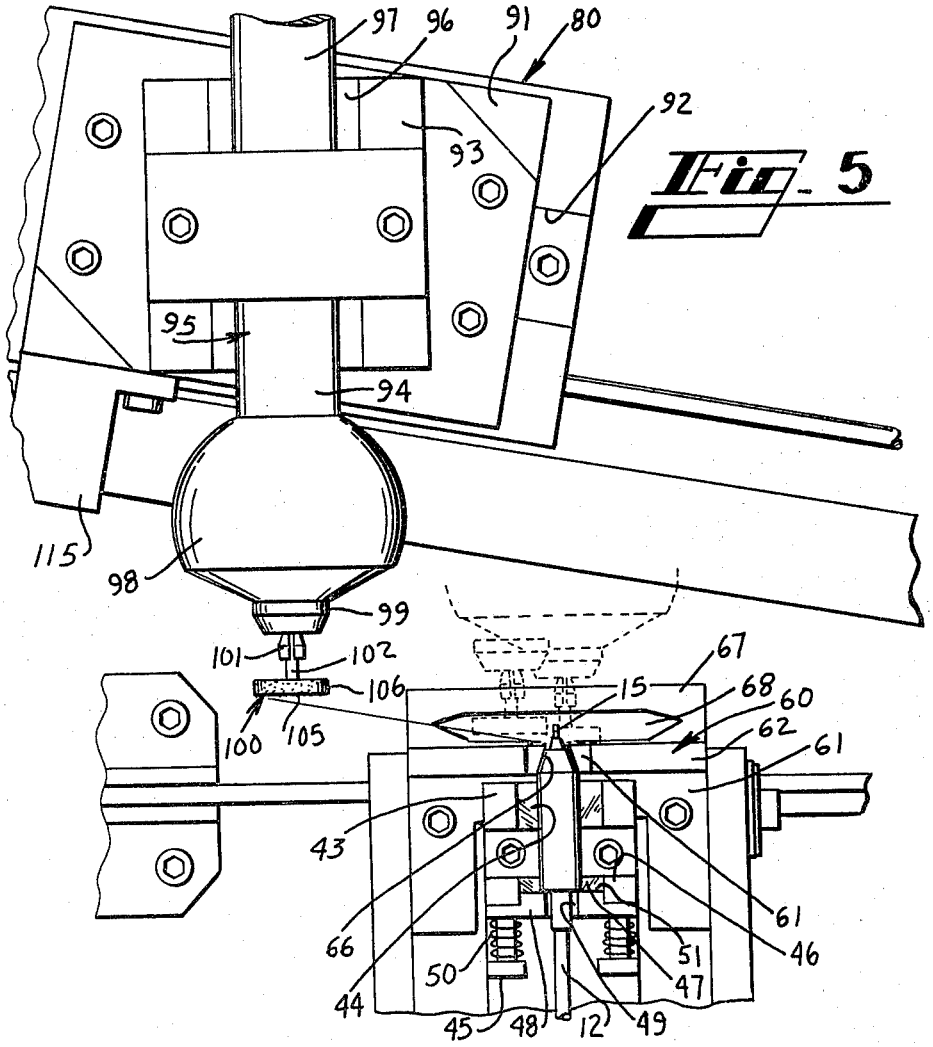
FIG. 5 is an enlarged plan view of a portion of FIG. 2.
Figure 7:
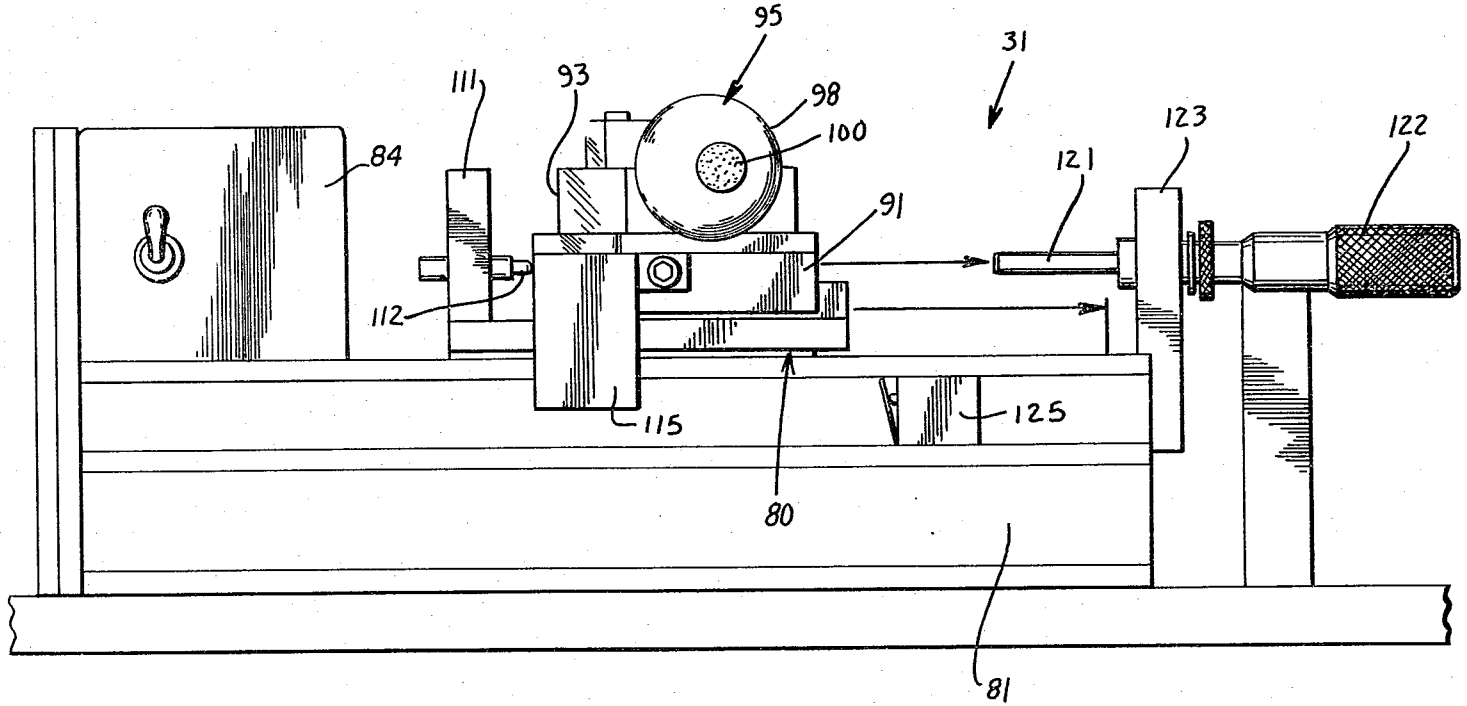
FIG. 7 is a front elevational view of a portion of the apparatus of FIG. 2 and taken along lines 7—7 thereof.

The abutment 60, as can be seen in FIGS. 1 and 4, is L-shaped having a bottom portion 62 of the L in engagement with the support 41 and with an upstanding portion 63 of the L having side portions 64—64. An opening 65 (see also FIG. 6) is formed through the wall 63 to receive the annular member 61 for receiving the primary conical portion 22 of the plug 21. The opening 65 in the wall 63 of the L-shaped abutment 60 is slit to communicate the opening 65 with one of the side surfaces of the upstanding portion.

The annular member 61 has a truncated conical gauging opening 66 (see FIG. 6) therethrough for receiving the primary conical portion of the plug 21 with the outwardly facing surface of the primary conical portion mating with the surface which defines the opening 66 in a repeatable manner. The opening 66 is precision made to be equivalent to that of the opening through the sleeve 23. The abrading of the end portion of the assembly of the plug 21 and the end length of the lightguide fiber 15 is accomplished so that the coplanar end surfaces of the secondary cone 26 of the plug 21 and of the fiber 15 are a predetermined distance "D" (see FIG. 3A) from a peripheral boundary, i.e. a circle, of the mating surface of the annular member 61 which defines the opening 66. Since the opening 66 is equivalent to that of the sleeve 23, the abrading causes the end face of each fiber 15 to be the predetermined distance "D" from a reference diameter 25 of a corresponding peripheral line of the conical portion 22 of a plug 21 so that the end faces of the opposing fibers are positioned in a predetermined manner when the plugs 21—21 are assembled to the sleeve.

The upstanding portion 63 of the L-shaped abutment 60 is in engagement with a block 67 which has an opening 68 formed therein for receiving severed end portions of fiber lightguides 15—15. The top of the L-shaped abutment 60 supports a tube 69 which is connected to a supply of alcohol that is used to positively lubricate, cool and clean the facilities 31 which are used for the severing and the lapping operations.

Turning again to FIGS. 1 and 2 it is seen that the severing and abrading facilities 31 of the apparatus 10 includes a carriage designated generally by the numeral 80 which is designed to be moved along a lathe-like bed 81 which is supported from the stand 33. The bed 81 is provided with a threaded rod 82 which extends lengthwise along the bed within a channel 83 and is operatively connected to the carriage 80. A motor 84 is connected to the threaded rod 82 to selectively control the rod to turn in a clockwise or counterclockwise direction to move the carriage lengthwise along the bed 81.

Turning now to FIGS. 1–2, 5 and 7, the carriage 80 supports a mounting plate 91 through a channeled ball bearing race 92 which provides relative motion between the carriage and the base plate. On the mounting plate 91 is mounted a support block 93 through which extends a housing 94 of a severing and lapping tool designated generally by the numeral 95. The support block 93 has a V-shaped opening 96 formed therethrough for receiving the generally cylindrical housing 94 of the severing and lapping tool 95. A forward end of the tool includes an air motor designated generally by the numeral 98, the air motor having a spindle 99 extending therefrom with a lapping wheel 100 mounted rotatably on the end of the spindle and held within a chuck 101. The air motor 98 is connected through a hose 106 that extends from a rear portion of the housing 97 to a supply (not shown). As a result of this arrangement, the lapping wheel 100 is mounted for translatory and for rotational motion.

The lapping wheel 100 is formed in the shape of a disc having a pin 102 extending therefrom, the pin being received in the chuck 101. In the preferred embodiment, the disc 100 includes a radial surface 105 which comprises diamond particles interspersed in a metallic matrix such as one sold by Accurate Diamond Tool Company of Hackensack, N.J. under the designation Grit 1000, and a peripheral edge surface 106. It has been found that the wear of such a disc is minimal thereby facilitating repeatability in successive abrading operations. Further, it has been found that such a disc cleanly severs the lightguide fiber 15 without tears or cracks adjacent to the freshly formed end surface.

The air motor 98 causes the disc 100 to be turned at a rotational speed generally in excess of 50,000 RPM. This is done to prevent vibration of the protruding end portion of the fiber 15 which could result in a resonant mode and then fracture of the end portion of the lightguide fiber 15. An air motor 98 which provides rotation of the disc 100 at speeds within this range and with minimal shaft vibration is one such as that manufactured by Karl A. Niese, Inc. under a model number PBE-197.

It should be observed that the axis of the tool 95 is in parallel alignment with the axis of the lightguide fiber 15 as supported in the holding facilities 30. In this way, the disc 100 of the tool 95 is perpendicular to that axis and the peripheral edge surface is parallel to the same axis. However, as can be further viewed in FIG. 2, the tool 95 is mounted on the carriage so that the axis of the tool is transverse to its path of travel along the threaded rod 82. For the preferred embodiment, the axis of the threaded rod 82 is at an angle $\alpha$ of about ten degrees to the normal to the axes of the tool 98 and the fiber 15. In this way as the carriage 80 is moved to the right as viewed in FIG. 2, the tool extends transverse of the threaded rod 82 and is moved with both an X and Y, translatory motion toward engagement with the fiber lightguide extending from the conical plug 21.

Figure 6:
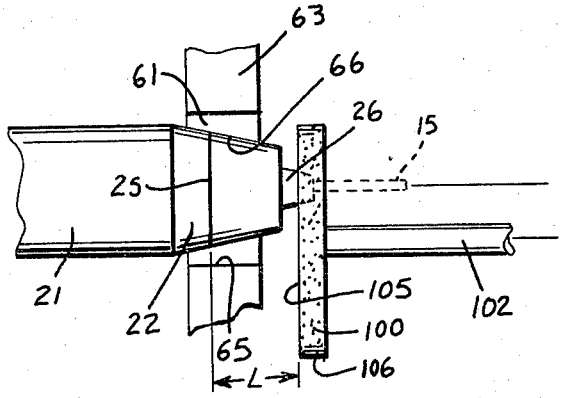
FIG. 6 is an enlarged side elevational view of a portion of a plug which terminates an end portion of a lightguide fiber as held in engagement with a mating surface and showing the relative position in a vertical plane of the axes of the lightguide fiber and a disc which is used to sever and to abrade the fiber.

From FIG. 6, it should be observed that the axis of rotation of the disc 100 is offset, generally in a vertical plane, from the axis of the fiber 15. In this way, the cutting speed of the disc 100 with respect to the fiber 15 is substantially constant. If instead, the axes were coincident, the speed seen by the fiber 15 would vary inversely with respect to the distance from the axis of the tool 95 to the fiber.

At an opposite end of the bed 81 there is mounted a hardened stop 121 which extends from a micrometer 122 that is supported in an end wall 123. An operator may turn the micrometer 122 in order to adjust the distance by which the stop 121 extends from the end wall 123 toward the mounting plate 91 and that is used to determine the distance between coplanar end faces of the plug 21 and lightguide fiber 15 and the reference diameter of the plug 21. The stop 121 is positioned to engage the mounting plate 91 and to discontinue the movement of the tool 95 along its path of travel when the disc 100 is spaced a predetermined distance "L" from a peripheral boundary of the gauging surface which defines the opening 66 in the annular member 61 (see FIG. 6). This peripheral boundary is chosen so that when it is the predetermined distance "L"from the disc, the reference diameter 25 of the plug 21 held in the facilities 30 is the predetermined distance "D" (see FIG. 3A) from the coplanar end faces of the plug 21 and of the lightguide fiber 15. In the preferred embodiment of the apparatus 10, the predetermined distances "L and D" are equal.

The mounting of the plate 91 for relative motion with respect to the carriage 80 is advantageous, particularly since this invention is useful in the preparation of lightguide fibers for connectorization. If the mounting plate 91 for the tool 95 were to bottom out together with the carriage 80, the motor should be a torque motor provided with a slip clutch so that it is immediately disengaged. Moreover, precise adjustment would be required to have the operation of the motor be discontinued when the mounting plate 91 engages the stop 121. The arrangement of this invention provides continuous, smooth motion of the mounting plate 91 and avoids any tearing or fracturing of the end portion of the lightguide fiber 15.

Figure 8A:
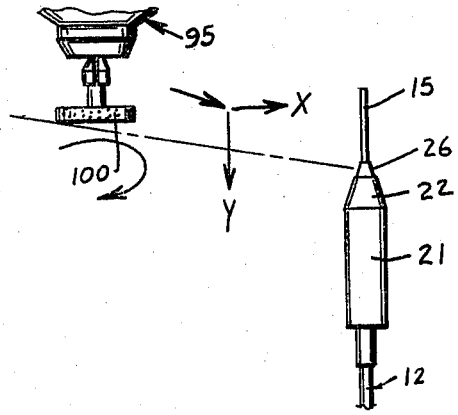
FIGS. 8A–8C are a sequence of views to show the geometrical relationship of a disc which is used to sever and to abrade a lightguide fiber which extends from a plug with respect to a fixture for holding the plug.
Figure 8B:
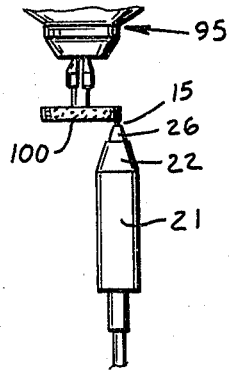
Figure 8C:
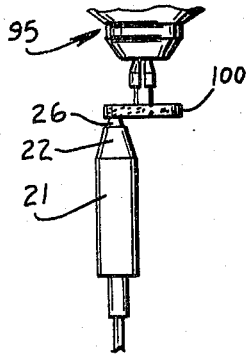

In the operation of the apparatus 10 as the carriage is moved by the threaded rod 82 toward the stop 121 (see FIG. 8A), the severing (see FIG. 8B) and then the lapping (see FIG. 8C) operations are caused to occur. During the operation of the apparatus 10, alcohol is supplied through the tube to a position directly above the projecting lightguide fiber. The alcohol which is fed from a supply along the plastic tube is used to lubricate, cool and clean portions of the apparatus 10 such as for example the disc 100 to help in preventing damage to the lightguide fiber.

Subsequently, the mounting plate 91 engages the stop 121 but since the support is mounted for relative movement with respect to the carriage 80, the mounting plate thereafter remains stationary with spring-loaded engagement against the moveable pin 112. The pin 112 moves to the left by an amount equal to that by which the carriage 80 continues to move to the right. This effectively permits further movement of the carriage 80 without a corresponding movement of the mounting plate 91 and the tool 95 until a portion 115 (see FIG. 7) of the carriage engages a microswitch 125 in order to cause the carriage to move leftward as viewed in FIG. 1 to a starting position for another cycle of operation.

Because of this unique mounting of the tool with respect to the fiber, the peripheral edge of the disc 100 at the intersection of the radial surface 105 and the peripheral surface 106 first engages the fiber lightguide and severs the excess portion thereof extending from the portion 22. The burst of alcohol from the tube above the L-shaped portion lubricates, cools and cleans the disc 100 as the severed portion positively enters the opening 67 in the block 66. A vacuum assist (not shown) may be used to remove alcohol fumes and machining dust from the vicinity of the end of the plug 21. Further movement of the tool 95 causes the abrasively coated face 105 of the disc 100 to lap and/or polish the extending end of the fiber lightguide so that the exposed portion thereof is substantially flush with the face of the conical plug 21.

While in the preferred embodiment, the apparatus 10 of this invention is used for severing and lapping the end of the lightguide fiber 15, the invention is not so limited. The term "preparation" as it is used to describe operations with respect to the end face of the lightguide fiber 15 may include severing, lapping and/or polishing. In the event that the apparatus 10 is used for polishing a newly formed end face of the fiber 15, the angle $\alpha$ is decreased in order to decrease the feed of the disc 100 into engagement with the fiber 15.

Further modifications of the apparatus 10 within the scope of this invention include the use of a vibratory tool instead of the rotating disc 100. The vibrating tool (not shown) is mounted for movement along a path of travel obliquely transverse of the axis of the lightguide fiber to sever the fiber, after which its movement along the path of travel is discontinued and the vibratory motion used to abrade the fiber 15 and plug 21 until their coplanar end faces are the predetermined distance from the reference dimension. Moreover, a tool having an abrading surface which is normal to the axis of the fiber 15 may be mounted for movement along an axis coincident with or parallel to the axis of the fiber to simply abrade the end face of the fiber and of the secondary cone 26 of the plug 21.

It should be apparent that while this invention is generally used to sever and to abrade the end portion of a lightguide fiber 15, there may be occasions when the fiber does not extend any appreciable distance beyond the secondary cone 26. In that event, the path of travel of the tool 95 of the apparatus 10 or any of the alternative embodiments described herein may be such that it does not sever the fiber but only abrades its end surface.

Figure 9:
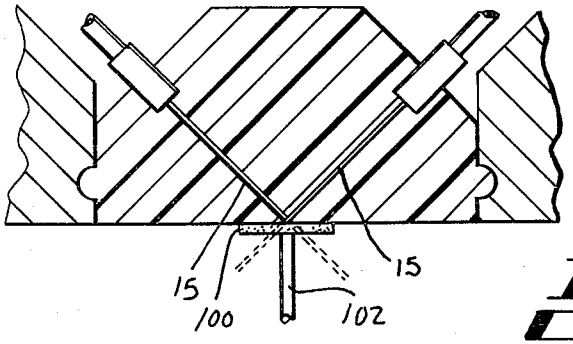
FIG. 9 shows another use of the apparatus of this invention for the preparation of end portions of lightguide fibers.

While this invention has been described in terms of an apparatus which is used to prepare an assembly of a plug and the lightguide fiber for connectorization, the invention may also be used to prepare an end portion of a lightguide fiber or fibers for other uses. For example the end portion of the lightguide fiber may be severed at an angle other than 90° (see FIG. 9) to the axis of the fiber. See for example an article by R. E. Wagner entitled "Multimode Optical-Fiber Access Port" on pages 80–83 of the Mar. 6–8, 1979 issue of the *Optical Fiber Communication Technical Digest*, IEEE catalog number 79CH1431-6 QEA. Moreover, the lightguide fiber may be temporarily supported in a holder during the end preparation with the holder being positioned in seating engagement with a mating surface having a repeatably engageable peripheral boundary.

It is to be understood that the above-described arrangements are simply illustrative of the invention. Other arrangements may be devised by those skilled in the art which will embody the principles of the invention and fall within the spirit and scope thereof.

What is claimed is:

1. A method of preparing an end portion of an assembly of a lightguide fiber and a connector element, said method including the steps of:

holding a lightguide fiber connector element, which terminates an end portion of a lightguide fiber, along a peripheral boundary thereof with a free end of the end portion of the lightguide fiber extending beyond an end surface of the connector element;

mounting a disc having a surface which is capable of abrading the lightguide fiber and which faces toward the end surface of the connector element for rotational movement about an axis which is perpendicular to the disc and which is parallel to a longitudinal axis of the end portion of the lightguide fiber and for translatory motion along a path of travel which is obliquely transverse of the axis of the lightguide fiber with the axes of the disc and of the fiber remaining parallel;

rotating the disc about its axis of rotation; and moving the rotating disc along the path of travel to cause the disc to sever the fiber to form an end surface and then to abrade the end surface of the fiber; while controlling said moving of the disc to discontinue the moving of the disc along the path of travel when the disc is spaced a predetermined distance from a reference dimension of the peripheral boundary of the connector element to cause the end surface of the lightguide fiber to be spaced the predetermined distance from the reference dimension of the connector element.

2. The method of claim 1, wherein the axis of rotation of the disc is offset from the longitudinal axis of the lightguide fiber to maintain substantially constant the rotational velocity of portions of the disc which abrade the fiber.

3. The method of claim 1, wherein the step of rotating the disc causes the disc to abrade an end surface of the connector element and of the lightguide fiber so that those end surfaces are substantially coplanar.

4. The method of claim 1, which also includes the steps of:

mounting a carriage for movement along said path of travel; and mounting the disc on the carriage, said mounting of the disc on the carriage being effective to allow relative motion between the disc and the carriage, the disc being moved along the path of travel and caused to sever the fiber and to abrade the end surface by moving the carriage continuously in one direction along said path of travel.

5. The method of claim 4, wherein the moving of said disc along said path of travel is discontinued subsequent to the severing of the fiber and to the abrading of the end surface with the distance between the disc and the reference dimension of the peripheral boundary being the predetermined distance.

6. The method of claim 4, wherein the movement of the carriage along the path of travel is continued subsequent to the discontinuance of movement of the disc along said path of travel.

7. The method of claim 1, wherein said step of holding the connector element includes the step of:

positioning the connector element by moving an outwardly facing surface of the connector element into seating engagement with a surface which is mateable with the outer surface of the connector element in a repeatable manner; and wherein the moving of the disc is discontinued when the disc is spaced a predetermined distance from a peripheral boundary of the surface which is mateable with the outer surface of the connector element to cause the end surface of the lightguide fiber to be spaced a predetermined distance from the reference dimension of the connector element.

8. An apparatus for preparing an end portion of a lightguide fiber which extends from an end portion of a plug of a connector, said apparatus including:

means for supporting the plug, said supporting means including means formed with a peripheral boundary for engaging an outwardly facing surface of the plug in a repeatable manner, the plug having a reference dimension associated with a peripheral boundary thereof;

means for preparing an end surface on the end portion of the lightguide fiber, said preparing means including means for abrading the end portion of the lightguide fiber and the end portion of the plug and means for severing the end portion of the fiber;

means for mounting said preparing means along an axis and for movement along a path of travel which is obliquely transverse of the longitudinal axis of the lightguide fiber with the axes of said preparing means and of the lightguide fiber being parallel;

means for moving said preparing means along the path of travel to cause said preparing means to sever the end portion of the lightguide fiber to form an end surface and then to abrade the end surface and the end portion of the plug from which the end portion of the lightguide fiber extends; and means for controlling said means for moving said preparing means to cause the abraded end surface of the lightguide fiber to be a predetermined distance from the reference dimension of said peripheral boundary of the plug, said controlling means including means for discontinuing the movement of said preparing means along the path of travel when end surfaces of the fiber and the plug are substantially coplanar and are spaced the predetermined distance from the reference dimension of the plug as measured along the longitudinal axis of the fiber.

9. The apparatus of claim 8, wherein said mounting means includes means for supporting said preparing means and further includes a carriage on which is mounted said supporting means, said mounting means being effective to permit relative motion between said supporting means and said carriage.

10. The apparatus of claim 9, wherein said controlling means includes means engaging said supporing means after the lightguide fiber surface has been severed and after the fiber end surface and the plug end have been abraded to cause said coplanar end surfaces to be said predetermined distance from said reference dimension for discontinuing the movement of said supporting means while permitting said carriage to continue to be moved.

11. The apparatus of claim 10, wherein said preparing means includes a disc having a radial surface which is covered with a material which is capable of being used to abrade the lightguide fiber;

means for mounting rotatably said disc along an axis which is parallel to the lightguide fiber; and means for causing said disc to be turned rotatably.

12. The apparatus of claim 11, wherein the mounting of said disc and its movement causes a peripheral edge surface of the disc to sever the end portion of the lightguide fiber to form an end surface and said radial surface to abrade the end surface of the fiber and the plug, said movement of said disc along said path of travel being discontinued when the end surfaces are said predetermined distance from said reference dimension.

13. The apparatus of claim 11, wherein said mounting means causes the axis of rotation of said disc to be offset from the axis of the lightguide fiber to cause the rotational velocity of the portion of the disc which abrades the fiber to be substantially constant.

14. The apparatus of claim 11, wherein said disc is made of a material that is substantially wear resistant.

15. The apparatus of claim 11, wherein said disc is caused to turn with a rotational velocity of about 50,000 RPM.

* * * * *